US009259371B2

(12) United States Patent
Zerhusen

(10) Patent No.: US 9,259,371 B2
(45) Date of Patent: Feb. 16, 2016

(54) SIDERAIL WITH STORAGE AREA

(75) Inventor: Robert M. Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 777 days.

(21) Appl. No.: 12/546,756

(22) Filed: Aug. 25, 2009

(65) Prior Publication Data

US 2011/0010851 A1 Jan. 20, 2011

Related U.S. Application Data

(63) Continuation of application No. 12/589,536, filed on Jul. 15, 2009, now abandoned.

(51) Int. Cl.
*A47C 21/08* (2006.01)
*A61G 7/05* (2006.01)

(52) U.S. Cl.
CPC ..... *A61G 7/0507* (2013.01); *A47C 21/08* (2013.01); *A61G 2007/0524* (2013.01)

(58) Field of Classification Search
CPC ..... A61G 7/05; A61G 7/0503; A61G 7/0507; A61G 2007/0524; A47C 21/00; A47C 21/08; A47C 31/00
USPC ..... 5/425, 503.1, 658
See application file for complete search history.

(56) References Cited

U.S. PATENT DOCUMENTS

| | | | |
|---|---|---|---|
| 3,100,899 | A | 8/1963 | Wright |
| 4,038,709 | A | 8/1977 | Kerwit |
| 4,183,015 | A | 1/1980 | Drew et al. |
| 4,195,829 | A | 4/1980 | Reser |
| 4,235,350 | A | 11/1980 | Valentino |
| 4,484,367 | A | 11/1984 | Jenkins |
| 4,504,992 | A | 3/1985 | Herron et al. |
| 4,612,679 | A | 9/1986 | Mitchell |
| 4,680,790 | A | 7/1987 | Packard et al. |
| D295,348 | S | 4/1988 | Muller |
| 4,811,435 | A | 3/1989 | Foster et al. |
| 4,831,673 | A | 5/1989 | Winckler |
| 4,836,113 | A | 6/1989 | Waddell et al. |
| 4,987,623 | A | 1/1991 | Stryker et al. |
| 4,993,089 | A | 2/1991 | Solomon et al. |
| 4,998,277 | A | 3/1991 | Rioux |
| 4,998,700 | A | 3/1991 | McKaig |
| 4,998,939 | A | 3/1991 | Potthast et al. |
| 5,005,230 | A | 4/1991 | Congdon |
| D317,537 | S | 6/1991 | Pino |
| 5,020,172 | A | 6/1991 | Timm |

(Continued)

FOREIGN PATENT DOCUMENTS

| | | | |
|---|---|---|---|
| EP | 2100579 | A2 | 9/2009 |
| GB | 2348365 | A | 10/2000 |

OTHER PUBLICATIONS

European Search Report for European Patent Application 10251254.8, Place of Search—The Hague, Date of Completion of the Search—Jun. 1, 2011.

*Primary Examiner* — Robert G Santos
(74) *Attorney, Agent, or Firm* — Jason Penninger

(57) ABSTRACT

A siderail assembly comprises a siderail with a siderail body. The siderail body has a storage area integrated therein. The storage area has a bottom surface, at least one side surface, and an opening. The storage area is configured to removably retain at least one object therein.

16 Claims, 10 Drawing Sheets

(56) References Cited

U.S. PATENT DOCUMENTS

| | | | |
|---|---|---|---|
| 5,022,327 | A | 6/1991 | Solomon |
| 5,022,810 | A | 6/1991 | Sherrow et al. |
| 5,026,017 | A | 6/1991 | Kreuzer |
| 5,038,430 | A | 8/1991 | Bly |
| 5,038,434 | A | 8/1991 | Navarrette |
| 5,040,813 | A | 8/1991 | Cumbie |
| 5,074,516 | A | 12/1991 | Lewis et al. |
| 5,083,334 | A | 1/1992 | Huck et al. |
| 5,083,625 | A | 1/1992 | Bleicher |
| 5,084,925 | A | 2/1992 | Cook |
| 5,097,550 | A | 3/1992 | Marra |
| 5,129,117 | A | 7/1992 | Celestina et al. |
| 5,129,611 | A | 7/1992 | Grover et al. |
| 5,144,898 | A | 9/1992 | Posly |
| 5,146,632 | A | 9/1992 | Li |
| 5,173,975 | A | 12/1992 | Peterson |
| 5,175,897 | A | 1/1993 | Marra |
| 5,187,824 | A | 2/1993 | Stryker |
| 5,191,663 | A | 3/1993 | Holder et al. |
| 5,205,223 | A | 4/1993 | Ball et al. |
| D336,577 | S | 6/1993 | Celestina et al. |
| 5,222,132 | A | 6/1993 | Rioux |
| 5,235,258 | A | 8/1993 | Schuerch |
| 5,236,162 | A | 8/1993 | Desjardins |
| 5,255,403 | A | 10/1993 | Ortiz |
| 5,257,765 | A | 11/1993 | Halle |
| 5,279,010 | A | 1/1994 | Ferrand et al. |
| 5,290,058 | A | 3/1994 | Adams et al. |
| 5,295,649 | A | 3/1994 | Lee |
| 5,314,243 | A | 5/1994 | McDonald et al. |
| 5,327,600 | A | 7/1994 | Hoogendoorn |
| 5,335,385 | A | 8/1994 | Brown |
| 5,337,682 | A | 8/1994 | Wiseman |
| D350,446 | S | 9/1994 | Sauvage |
| 5,344,169 | A | 9/1994 | Pryor et al. |
| 5,348,324 | A | 9/1994 | Trotta |
| 5,349,710 | A | 9/1994 | Dunn |
| 5,359,741 | A | 11/1994 | Lang |
| 5,365,623 | A | 11/1994 | Springer |
| 5,365,862 | A | 11/1994 | Peterson |
| 5,370,246 | A | 12/1994 | Traynor |
| 5,381,571 | A | 1/1995 | Gabhart |
| 5,384,927 | A | 1/1995 | Mardero et al. |
| 5,416,839 | A | 5/1995 | Lee |
| 5,418,988 | A | 5/1995 | Iura |
| 5,437,067 | A | 8/1995 | Bernstein et al. |
| 5,438,939 | A | 8/1995 | Clarke |
| 5,461,673 | A | 10/1995 | Coons |
| 5,473,997 | A | 12/1995 | Solomon et al. |
| 5,476,241 | A | 12/1995 | Helman |
| 5,481,772 | A | 1/1996 | Glynn et al. |
| 5,511,674 | A | 4/1996 | Boyd et al. |
| D370,135 | S | 5/1996 | Meiners |
| 5,516,244 | A | 5/1996 | Baka |
| D370,795 | S | 6/1996 | Skov et al. |
| 5,524,304 | A | 6/1996 | Shutes |
| D372,818 | S | 8/1996 | Snell |
| 5,542,136 | A | 8/1996 | Tappel |
| 5,544,745 | A | 8/1996 | Famorca |
| 5,551,105 | A | 9/1996 | Short |
| D375,641 | S | 11/1996 | Dhanapal et al. |
| 5,577,277 | A | 11/1996 | Sundberg et al. |
| 5,604,942 | A | 2/1997 | Allevato et al. |
| 5,606,917 | A | 3/1997 | Cauffiel |
| 5,623,948 | A | 4/1997 | Van Morris |
| 5,651,152 | A | 7/1997 | Ritchie et al. |
| D382,428 | S | 8/1997 | Meier et al. |
| D382,746 | S | 8/1997 | Meier et al. |
| 5,671,490 | A | 9/1997 | Wu |
| 5,689,839 | A | 11/1997 | Laganiere et al. |
| 5,699,564 | A | 12/1997 | Heh |
| 5,715,548 | A | 2/1998 | Weismiller et al. |
| 5,732,423 | A | 3/1998 | Weismiller et al. |
| 5,737,781 | A | 4/1998 | Votel |
| 5,742,959 | A | 4/1998 | Froelich |
| 5,749,112 | A | 5/1998 | Metzler |
| 5,749,437 | A | 5/1998 | Weller |
| 5,758,374 | A | 6/1998 | Ronci |
| 5,758,972 | A | 6/1998 | Mack et al. |
| 5,775,234 | A | 7/1998 | Solomon et al. |
| 5,779,206 | A | 7/1998 | Harris et al. |
| 5,781,945 | A | 7/1998 | Scherer et al. |
| 5,784,732 | A | 7/1998 | Vail |
| 5,787,530 | A | 8/1998 | Brix |
| 5,802,636 | A | 9/1998 | Corbin et al. |
| 5,802,640 | A | 9/1998 | Ferrand et al. |
| D402,543 | S | 12/1998 | Thieman |
| 5,842,238 | A | 12/1998 | Herrick et al. |
| 5,857,685 | A | 1/1999 | Phillips et al. |
| 5,863,055 | A | 1/1999 | Kasravi et al. |
| 5,878,452 | A | 3/1999 | Brooke et al. |
| 5,887,940 | A | 3/1999 | Anderson et al. |
| 5,890,605 | A | 4/1999 | Percudani |
| 5,894,805 | A | 4/1999 | Raasch et al. |
| 5,898,964 | A | 5/1999 | Stanley |
| 5,906,016 | A | 5/1999 | Ferrand et al. |
| 5,906,017 | A | 5/1999 | Ferrand et al. |
| 5,926,870 | A | 7/1999 | Branca-Barnes et al. |
| 6,006,376 | A | 12/1999 | Williamson |
| 6,008,598 | A | 12/1999 | Luff et al. |
| 6,021,533 | A | 2/2000 | Ellis et al. |
| 6,041,930 | A | 3/2000 | Cockburn |
| 6,073,284 | A | 6/2000 | Borders |
| 6,073,285 | A | 6/2000 | Ambach et al. |
| D427,465 | S | 7/2000 | Thom et al. |
| 6,116,419 | A | 9/2000 | Campagna et al. |
| 6,134,731 | A | 10/2000 | Thom et al. |
| 6,137,404 | A | 10/2000 | O'Connor |
| 6,138,305 | A | 10/2000 | Smith |
| 6,148,459 | A | 11/2000 | Verhulst |
| 6,163,903 | A | 12/2000 | Weismiller et al. |
| D436,031 | S | 1/2001 | Castaldo |
| D436,474 | S | 1/2001 | Morren |
| 6,167,580 | B1 | 1/2001 | Draheim et al. |
| 6,182,310 | B1 | 2/2001 | Weismiller et al. |
| 6,185,767 | B1 | 2/2001 | Brooke et al. |
| 6,192,535 | B1 | 2/2001 | Warner et al. |
| 6,208,250 | B1 | 3/2001 | Dixon et al. |
| 6,228,385 | B1 | 5/2001 | Shick |
| 6,253,397 | B1 | 7/2001 | Bartow et al. |
| 6,253,399 | B1 | 7/2001 | Wagner |
| 6,269,753 | B1 | 8/2001 | Roddan |
| 6,320,510 | B2 | 11/2001 | Menkedick et al. |
| 6,336,235 | B1 | 1/2002 | Ruehl |
| 6,336,555 | B1 | 1/2002 | Breeden |
| 6,347,419 | B1 | 2/2002 | Kurtz |
| 6,347,440 | B1 | 2/2002 | Duval et al. |
| 6,360,385 | B1 | 3/2002 | Lewandowski |
| 6,374,437 | B1 | 4/2002 | Voelker |
| 6,390,213 | B1 | 5/2002 | Bleicher |
| 6,401,277 | B1 | 6/2002 | Savage et al. |
| 6,405,393 | B2 | 6/2002 | Megown |
| 6,427,264 | B1 | 8/2002 | Metz et al. |
| 6,438,776 | B2 | 8/2002 | Ferrand et al. |
| D463,179 | S | 9/2002 | Brooke |
| 6,450,337 | B1 | 9/2002 | Campagna et al. |
| 6,453,491 | B1 | 9/2002 | Wells et al. |
| 6,471,311 | B1 | 10/2002 | Snyder |
| 6,473,921 | B2 | 11/2002 | Brooke et al. |
| 6,481,030 | B2 | 11/2002 | Bravo et al. |
| 6,481,688 | B1 | 11/2002 | Welling et al. |
| 6,486,792 | B1 | 11/2002 | Moster et al. |
| D467,754 | S | 12/2002 | Chen |
| 6,519,794 | B1 | 2/2003 | Aarestad et al. |
| D471,706 | S | 3/2003 | Campagna et al. |
| 6,543,369 | B1 | 4/2003 | Swensson et al. |
| 6,564,404 | B1 | 5/2003 | Nanahara |
| 6,575,213 | B1 | 6/2003 | Houk |
| 6,601,674 | B2 | 8/2003 | Murray |
| 6,601,860 | B2 | 8/2003 | Potter |
| D479,070 | S | 9/2003 | Goodwin et al. |
| 6,622,364 | B2 | 9/2003 | Hamilton et al. |
| 6,622,980 | B2 | 9/2003 | Boucher et al. |
| 6,640,361 | B2 | 11/2003 | Heimbrock et al. |

(56) References Cited

U.S. PATENT DOCUMENTS 6,658,680 B2 12/2003 Osborne et al.
6,678,907 B1 1/2004 Voelker et al.
6,684,420 B2 2/2004 Koenig et al.
6,691,345 B2 2/2004 Nanahara
6,704,952 B2 * 3/2004 Kurtz ..... 5/308
6,708,991 B1 3/2004 Ortlieb
D488,941 S 4/2004 Lemire et al.
6,721,975 B1 4/2004 Lemire
6,728,982 B2 5/2004 Lemire et al.
6,728,984 B2 5/2004 Dietrich
6,729,502 B2 5/2004 Lewis et al.
6,769,143 B2 8/2004 Clarke
6,781,517 B2 * 8/2004 Moster et al. ..... 340/4.11
6,795,988 B2 9/2004 Hueppe
6,799,340 B2 10/2004 Schatz
6,802,093 B1 10/2004 Pope-Brown
6,829,793 B2 12/2004 Brooke et al.
6,851,142 B2 2/2005 Stryker et al.
6,854,139 B2 2/2005 Lamy
6,877,442 B2 4/2005 Helle
6,915,913 B2 7/2005 Cardinell
6,925,944 B1 8/2005 Miller et al.
6,928,673 B2 8/2005 Risk, Jr.
6,938,289 B2 9/2005 Morin
6,941,598 B2 9/2005 Ferrand et al.
6,942,130 B1 9/2005 Duva
6,952,849 B2 10/2005 Pacella
6,957,461 B2 10/2005 Osborne et al.
6,994,050 B2 2/2006 Johnson et al.
7,007,323 B2 3/2006 Zerhusen et al.
7,013,508 B2 3/2006 Wu
7,017,208 B2 3/2006 Weismiller et al.
7,024,708 B2 4/2006 Tomas et al.
7,028,353 B2 4/2006 Waldman et al.
7,043,810 B2 5/2006 Bober
D522,750 S 6/2006 Girod
7,073,220 B2 7/2006 Simmonds et al.
7,093,311 B2 8/2006 Gnoyke
7,103,928 B1 9/2006 Childs
7,121,409 B1 10/2006 Hamilton et al.
7,165,687 B1 1/2007 Stevens et al.
7,171,708 B2 2/2007 Osborne et al.
7,200,882 B2 4/2007 Heimbrock
7,200,968 B2 4/2007 Jaworski
D543,722 S 6/2007 Cookson
7,231,678 B2 6/2007 Parker
7,237,286 B1 7/2007 Kim
7,237,287 B2 7/2007 Weismiller et al.
7,257,850 B1 8/2007 Tekulve
D552,340 S 10/2007 Graves et al.
D552,366 S 10/2007 Graves et al.
D555,350 S 11/2007 Graves et al.
7,293,645 B2 11/2007 Harper et al.
7,296,312 B2 11/2007 Menkedick et al.
D559,043 S 1/2008 Peota et al.
7,325,264 B2 2/2008 Holmes
D566,249 S 4/2008 Graves et al.
D566,250 S 4/2008 Graves et al.
D567,915 S 4/2008 Graves et al.
7,364,184 B2 4/2008 Delhotal
7,398,951 B1 7/2008 Sugalski et al.
7,406,731 B2 8/2008 Menkedick et al.
7,407,177 B2 8/2008 Darling, III
7,426,759 B2 9/2008 Donaldson
7,430,771 B2 10/2008 Heimbrock
7,438,194 B2 10/2008 Wang
7,454,804 B2 11/2008 Macari et al.
7,454,805 B2 11/2008 Osborne et al.
7,458,114 B2 12/2008 Troutman
7,461,420 B2 12/2008 Kim
7,464,425 B2 12/2008 Chambers et al.
7,497,351 B2 3/2009 Amundson et al.
7,506,390 B2 3/2009 Dixon et al.
7,520,006 B2 4/2009 Menkedick et al.
7,523,515 B2 4/2009 Allen et al.
7,523,900 B1 4/2009 Hlatky
7,526,822 B2 5/2009 Joyce
7,533,429 B2 5/2009 Menkedick et al.
7,559,101 B2 7/2009 Vrzalik et al.
7,559,102 B1 7/2009 Benzo et al.
7,581,269 B2 9/2009 Chen et al.
7,610,637 B2 11/2009 Menkedick et al.
7,610,638 B2 11/2009 Kramer et al.
8,499,384 B2 * 8/2013 Zerhusen ..... 5/425
8,677,528 B2 * 3/2014 Hookway et al. ..... 5/425
2001/0011393 A1 8/2001 Brooke et al.
2001/0027578 A1 10/2001 Brooke et al.
2001/0029628 A1 10/2001 Ferrand et al.
2001/0032362 A1 10/2001 Welling et al.
2002/0002742 A1 1/2002 Osborne et al.
2002/0059679 A1 5/2002 Weismiller et al.
2002/0061225 A1 5/2002 Boucher et al.
2002/0066142 A1 6/2002 Osborne et al.
2002/0080037 A1 6/2002 Dixon et al.
2002/0095728 A1 7/2002 Weismiller
2002/0144348 A1 10/2002 Ganance
2002/0157180 A1 10/2002 Koenig et al.
2003/0009952 A1 1/2003 Gallant et al.
2003/0019038 A1 1/2003 Welling et al.
2003/0037372 A1 2/2003 Andriunas et al.
2003/0051291 A1 3/2003 Brooke et al.
2003/0051292 A1 3/2003 Ferrand et al.
2003/0056293 A1 3/2003 Brooke et al.
2003/0093862 A1 5/2003 Hanson et al.
2003/0112147 A1 6/2003 George et al.
2003/0159214 A1 * 8/2003 Kurtz ..... 5/503.1
2003/0167568 A1 9/2003 Brooke
2004/0000010 A1 1/2004 Zerhusen et al.
2004/0060111 A1 4/2004 Alverson
2004/0064885 A1 4/2004 Moster et al.
2004/0128760 A1 7/2004 Schatz
2004/0139546 A1 7/2004 Ferrand et al.
2004/0148698 A1 8/2004 Snyder et al.
2004/0148705 A1 8/2004 Stryker et al.
2004/0158923 A1 8/2004 Perez et al.
2004/0163177 A1 8/2004 Stryker et al.
2004/0177443 A1 9/2004 Simmonds et al.
2004/0177445 A1 9/2004 Osborne et al.
2004/0187212 A1 9/2004 Pacella
2004/0207244 A1 10/2004 McKellar
2005/0034637 A1 2/2005 Heimbrock
2005/0125899 A1 6/2005 Hanson et al.
2005/0132935 A1 6/2005 Lahmann et al.
2005/0160527 A1 7/2005 Morin
2005/0229311 A1 10/2005 Brooke et al.
2006/0026759 A1 2/2006 Flannery et al.
2006/0031995 A1 2/2006 Barkhouse
2006/0037140 A1 2/2006 Clute
2006/0038097 A1 2/2006 Diller
2006/0053554 A1 3/2006 Acton
2006/0056616 A1 * 3/2006 Heimbrock ..... 379/428.01
2006/0059621 A1 3/2006 Poulos et al.
2006/0080776 A1 4/2006 Clapper et al.
2006/0085612 A1 4/2006 Nakano et al.
2006/0090259 A1 5/2006 Castonguay
2006/0090260 A1 5/2006 Stryker et al.
2006/0101578 A1 5/2006 Shalikar
2006/0107460 A1 5/2006 Wiggins et al.
2006/0117481 A1 6/2006 Stryker et al.
2006/0130237 A1 6/2006 Clapper et al.
2006/0150332 A1 7/2006 Weismiller et al.
2006/0170173 A1 8/2006 Darling
2006/0172269 A1 8/2006 Langone et al.
2006/0179569 A1 8/2006 Vrzalik et al.
2006/0180054 A1 8/2006 George et al.
2006/0191072 A1 8/2006 Hempker et al.
2006/0195984 A1 9/2006 HakamiuN et al.
2006/0225204 A1 10/2006 Bretschger et al.
2006/0225205 A1 10/2006 Troutman
2006/0261569 A1 11/2006 Delhotal
2006/0283727 A1 12/2006 Nelson et al.
2007/0069093 A1 3/2007 Graham et al.
2007/0101498 A1 5/2007 Voelker
2007/0151027 A1 7/2007 Hensley et al.

(56) References Cited

U.S. PATENT DOCUMENTS

| | | | | |
|---|---|---|---|---|
| 2007/0151032 | A1 | 7/2007 | Heavrin | |
| 2007/0166188 | A1 | 7/2007 | Ryterski et al. | |
| 2007/0169266 | A1 | 7/2007 | Kim | |
| 2007/0174964 | A1 | 8/2007 | Lemire et al. | |
| 2007/0180616 | A1 | 8/2007 | Newkirk et al. | |
| 2007/0192958 | A1 | 8/2007 | Heimbrock | |
| 2007/0194801 | A1 | 8/2007 | Hedges et al. | |
| 2007/0240263 | A1 | 10/2007 | Kang | |
| 2007/0251009 | A1 | 11/2007 | Kim | |
| 2008/0010745 | A1 | 1/2008 | Giesser | |
| 2008/0098530 | A1 | 5/2008 | Chen et al. | |
| 2008/0111039 | A1 | 5/2008 | Papendieck et al. | |
| 2008/0111042 | A1 | 5/2008 | Papendieck et al. | |
| 2008/0121150 | A1 | 5/2008 | Picchio | |
| 2008/0201844 | A1 | 8/2008 | Gemeline et al. | |
| 2008/0209631 | A1 | 9/2008 | Thomas et al. | |
| 2008/0209633 | A1 | 9/2008 | Ito et al. | |
| 2008/0250562 | A1 | 10/2008 | Tekulve | |
| 2008/0289107 | A1 | 11/2008 | Vrzalik | |
| 2008/0309051 | A1 | 12/2008 | Elflein | |
| 2009/0007332 | A1 | 1/2009 | Wu et al. | |
| 2009/0007333 | A1 | 1/2009 | Guguin et al. | |
| 2009/0007334 | A1 | 1/2009 | Stryker et al. | |
| 2009/0013465 | A1 | 1/2009 | Guguin | |
| 2009/0229050 | A1 | 9/2009 | Heimbrock | |
| 2009/0236254 | A1 | 9/2009 | Jenkins et al. | |
| 2009/0260159 | A1 | 10/2009 | Buchanan | |
| 2011/0010851 | A1* | 1/2011 | Zerhusen | 5/425 |
| 2011/0010853 | A1* | 1/2011 | Howell et al. | 5/425 |
| 2011/0010854 | A1* | 1/2011 | Zerhusen et al. | 5/425 |
| 2011/0247137 | A1* | 10/2011 | Herman et al. | 5/600 |
| 2012/0090091 | A1* | 4/2012 | Hookway et al. | 5/425 |
| 2012/0233774 | A1* | 9/2012 | Zerhusen | 5/425 |
| 2013/0146601 | A1 | 6/2013 | Zerhusen et al. | |
| 2014/0338124 | A1* | 11/2014 | Newkirk et al. | 5/280 |

* cited by examiner

SIDERAIL WITH STORAGE AREA

This Application claims priority to U.S. patent application Ser. No. 12/589,536 titled SIDERAIL WITH STORAGE AREA filed on Jul. 15, 2009, the contents of which are incorporated herein by reference.

BACKGROUND OF THE DISCLOSURE

This disclosure relates generally to person-support apparatuses. More particularly, but not exclusively, one illustrative embodiment relates to a person-support apparatus including a siderail with an integrated storage area.

People staying in hospitals can often bring personal belongings with them. The belongings can be collected by caregivers and stored until the person is discharged or the person requests an item. The belongings can be stored in a storage room that can include, for example, lockers, storage bins, drawers, and/or bags with identifying information, such as, the patient's room number, listed thereon, and/or a list of the items and/or bin, locker, or bag numbers and/or location put on the patient's medical chart. The people can also be provided with storage space for storing personal belongings or other objects in the room they are assigned to, for example, in various shelving units or other furniture storage areas, such as, drawers and/or closets. While various person-support apparatuses have been developed, there is still room for development. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include a siderail with an indented portion that defines a storage area to place objects within.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout:

FIG. 9 is a perspective side view of the siderail of FIG. 1, including a storage area according to yet another embodiment of the current disclosure; and.

DETAILED DESCRIPTION OF THE DRAWINGS

Figure 1:
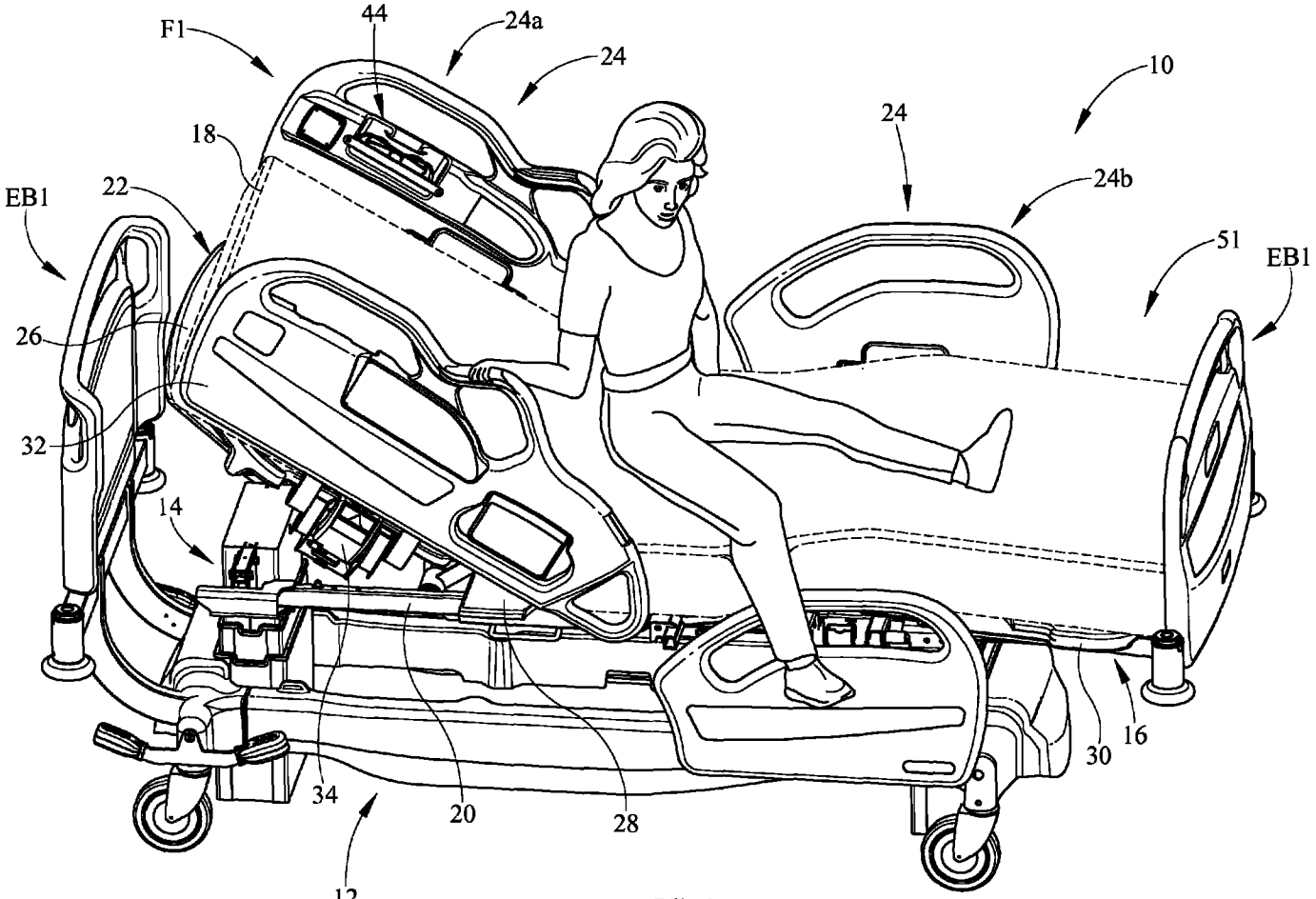
FIG. 1 is a perspective side view of a person-support apparatus with siderails coupled to a frame of the person-support apparatus according to an embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a siderail with an indented portion that defines a storage area to place objects within. Another illustrative embodiment can include a siderail with an indented portion that defines a storage area to place objects within and a retaining element to maintain the objects in the storage area.

Figure 2:
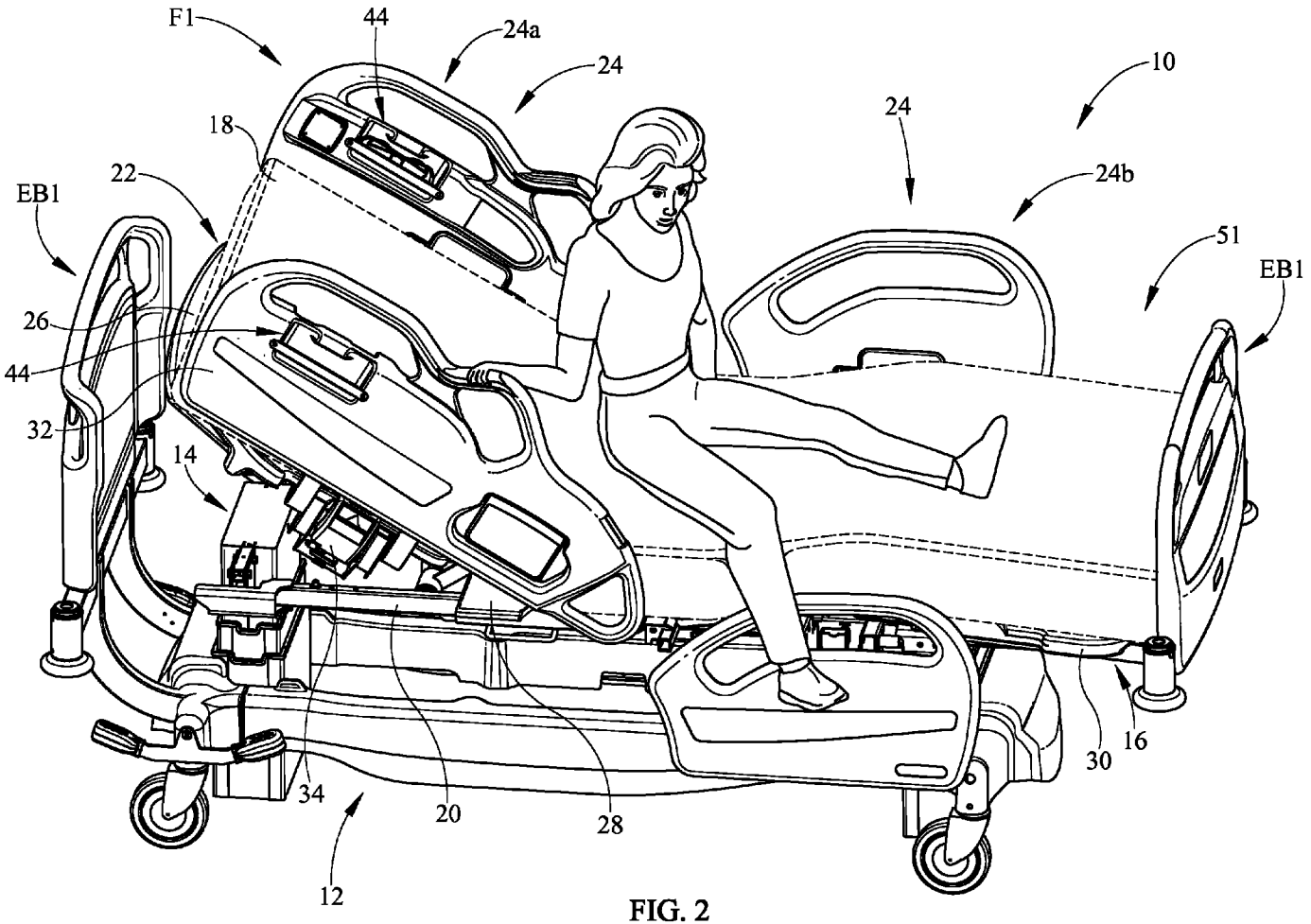
FIG. 2 is a perspective side view of a person-support apparatus with siderails coupled to a frame of the person-support apparatus according to another embodiment of the current disclosure.
Figure 3:
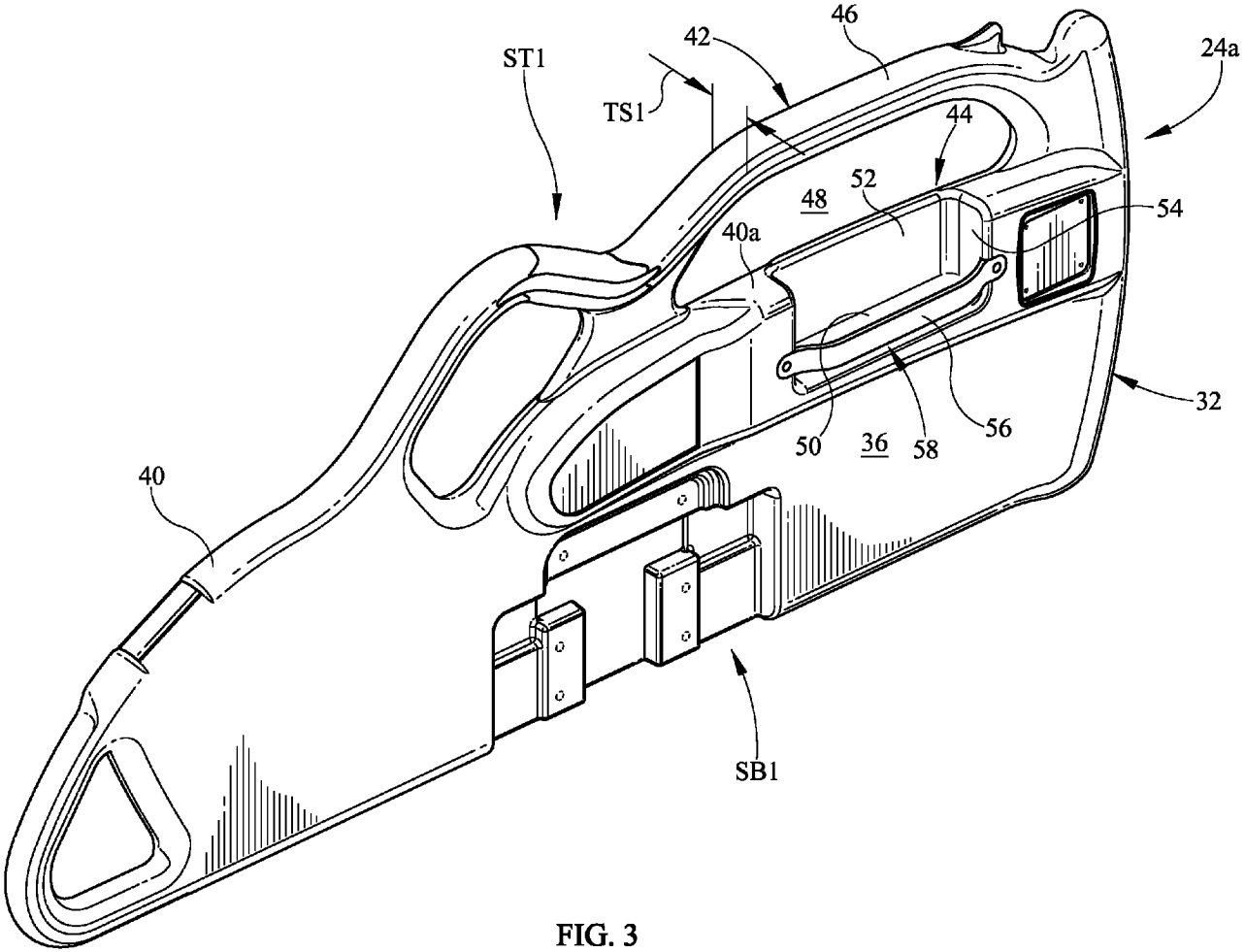
FIG. 3 is a perspective side view of a head siderail of FIG. 1, including a storage area on a first surface of a head siderail according to an embodiment of the current disclosure.

A person-support apparatus 10 according to one illustrative embodiment of the current disclosure is shown in FIGS. 1 and 2. The person-support apparatus 10 can have a first section F1 or head support section F1, where the head of a person can be positioned and a second section S1 or a foot support section S1, where the feet of the person can be positioned. It should be appreciated that the first section F1 and the second section S1 can be portions of the same section. In one illustrative embodiment, the person-support apparatus 10 can be a hospital bed. It should be appreciated that the person-support apparatus 10 can also be a hospital stretcher or an operating table. The person-support apparatus 10 can include a lower frame 12 or base 12, a plurality of supports 14 coupled with the lower frame 12, and an upper frame 16 supported on the supports 14 above the lower frame 12. It should be appreciated that the supports 14 can be lift mechanisms 14 that can move the upper frame 16 with respect to the lower frame 12. It should also be appreciated that in one illustrative embodiment the person-support apparatus 10 can support a person-support surface 18 thereon. The upper frame 16 can include an intermediate frame 20, a deck 22, siderails 24, and endboards EB1 as shown in FIGS. 1 and 2. The intermediate frame 20 can be coupled with the supports 14 and can support the deck 22 thereon as shown in FIGS. 1 and 2. The deck 22 can include a head portion 26, a seat portion 28, and a foot portion 30. The head portion 26, the seat portion 28, and the foot portion 30 can be movably coupled with each other and/or the intermediate frame 20.

The siderails 24 can include a siderail body 32 with a top portion ST1 and a bottom portion SB1, and a siderail linkage 34 as shown in FIGS. 1-9. In one illustrative embodiment, the siderails 24 can have a thickness TS1 of between about 1.5 inches and about 2 inches. It should be appreciated that the siderails 24 can have a thickness TS1 of less than 3 inches. The siderail linkage 34 can be coupled to the bottom portion SB1 of the siderail body 32 and can couple the siderails 24 to the deck 22 and/or the intermediate frame 20. In one illustrative embodiment, the siderails 24 can be coupled to the head portion 26 of the deck 22 (i.e., a first siderail 24*a* or a head siderail 24*a*) and/or coupled to the foot portion 30 of the deck 22 and/or the intermediate frame 20 (i.e., a second siderail 24*b* or a foot siderail 24*b*) as shown in FIG. 1. The siderail linkage 34 can be configured to can facilitate movement of the siderails 24 between a deployed/operation position and a storage position. In the deployed/operation position, as shown in FIG. 1, the siderails 24 can be present above the upper frame 16. In the storage position, the siderails 24 can be moved to a lower position below the deployed/operation position. It should be appreciated that the siderail linkage 34 can include a locking mechanism (not shown) that can maintain the siderails 24 in one of the operating and/or storage position when locked and can facilitate movement of the siderails 24 between the operating and storage position when unlocked.

The siderail body 32 can include a first surface 36, a second surface 38, a side surface 40 extending between the first surface 36 and the second surface 38, a grip portion 42, and a storage area 44 as shown in FIGS. 1-9. It should be appreciated that the siderail 24 can include a caregiver interface (not shown) that can be operable to control various functionalities of the person-support apparatus 10. The first surface 36 and the second surface 38 can be substantially parallel to one another. The first surface 36 can be oriented such that the first surface 36 faces towards a person supported on the person-support surface 18 and the second surface 38 can be oriented such that the second surface 38 faces away from the person supported on the person-support apparatus 10.

The grip portion 42 can be configured to be gripped by a person to assist the person with ingress/egress to/from the person support apparatus 10 as shown in FIGS. 1-9. In one illustrative embodiment, the grip portion 42 can be located along the top portion ST1 and can include a grip 46 and a grip opening 48 that can pass through the siderail body 32 and be configured to allow a person to wrap at least a portion of their fingers/hand around the grip 46 as shown in FIGS. 1-9. It should be appreciated that the grip portion 32 can include a grip opening cover (not shown) or net (not shown) that can be positioned within the grip opening 48 so that a person can partially wrap their fingers around the grip 46. In one illustrative embodiment, an upper portion of the grip opening 48 can define the bottom of the grip 46 and a lower portion of the grip opening 48 opposite the upper portion of the grip opening 48 can define a portion of the upper side surface 40*a*.

The storage area 44 can be configured to hold one or more objects as shown in FIGS. 1-10. It should be appreciated that the storage area 44 can include a portion that can protrude from the first surface 36 and/or the second surface 38 such that the total width of the siderail body 32 is less than about 3 inches. The storage area 44 can allow a person supported on the person-support apparatus 10 to store personal belongings PB1 within reach, which can reduce the time spent by the caregiver in fetching the personal belongings PB1 of the person. The one or more personal belongings PB1 can be or can include at least one of eye glasses, jewelry, dentures, photos, music playing devices, headphones, cellular phones, magazines, books, personal organizers, pens/pencils, tissues, or toiletries, or other personal electronic devices, personal belongings or objects. The one or more personal belongings can also include caregiver objects, such as, medical diagnosis equipment, medications, treatment or medication administering devices, syringes, bandages, recording materials, pens/pencils, or other caregiver devices, equipment, or materials.

Figure 10:
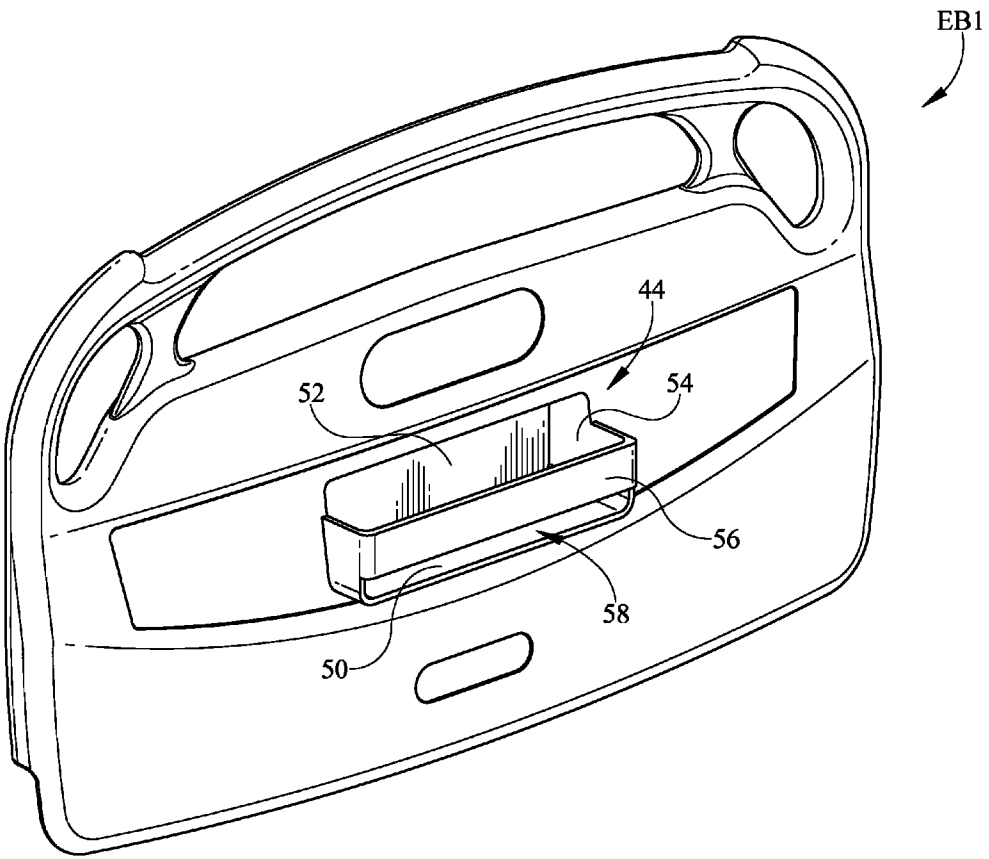
FIG. 10 is a perspective side view of an endboard of FIG. 1, including a storage area according to yet another embodiment of the current disclosure

In one illustrative embodiment, the storage area 44 can be recessed into the siderail body 32 and can include a storage area base 50, a storage area back 52, storage area sides 54, and a retaining element 56 as shown in FIGS. 1-9. In another illustrative embodiment, the storage area 44 can be recessed into an endboard EB1 as shown in FIG. 10. It should be appreciated that a portion of the storage area 44 can extend from the siderail body 32 and/or the endboard EB1. It should also be appreciated that at least a portion of the storage area back 52 and the storage area sides 54 can be transparent. It should further be appreciated that the storage area 44 can include an opening (not shown) between a portion of the storage area base 50 and a portion of at least one of the storage area back 52 and the storage area sides 54 to facilitate cleaning of the storage area 44.

Figure 4:
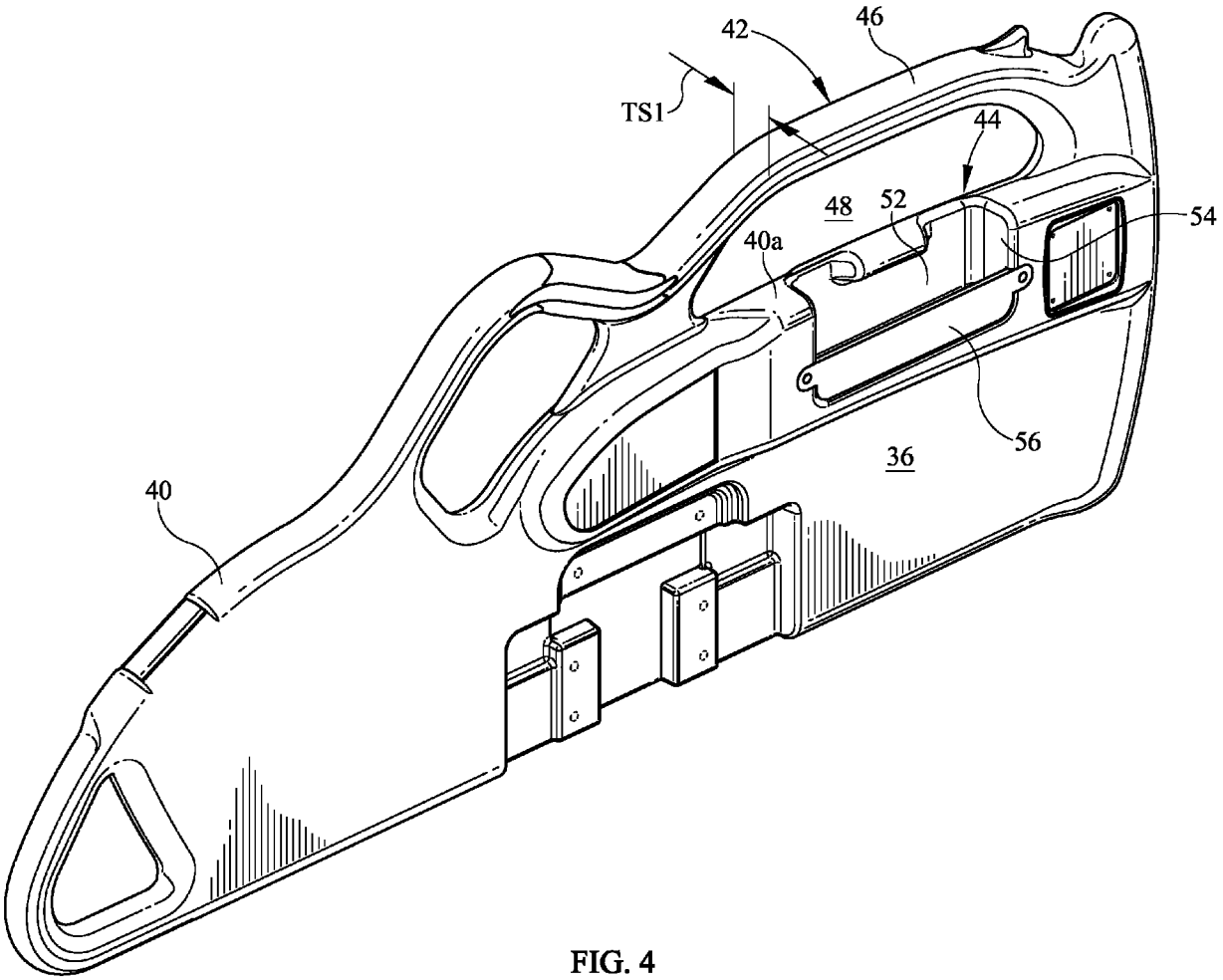
FIG. 4 is a perspective side view of a head siderail of FIG. 1, including a storage area on a second surface of the head siderail according to an embodiment of the current disclosure.
Figure 5:
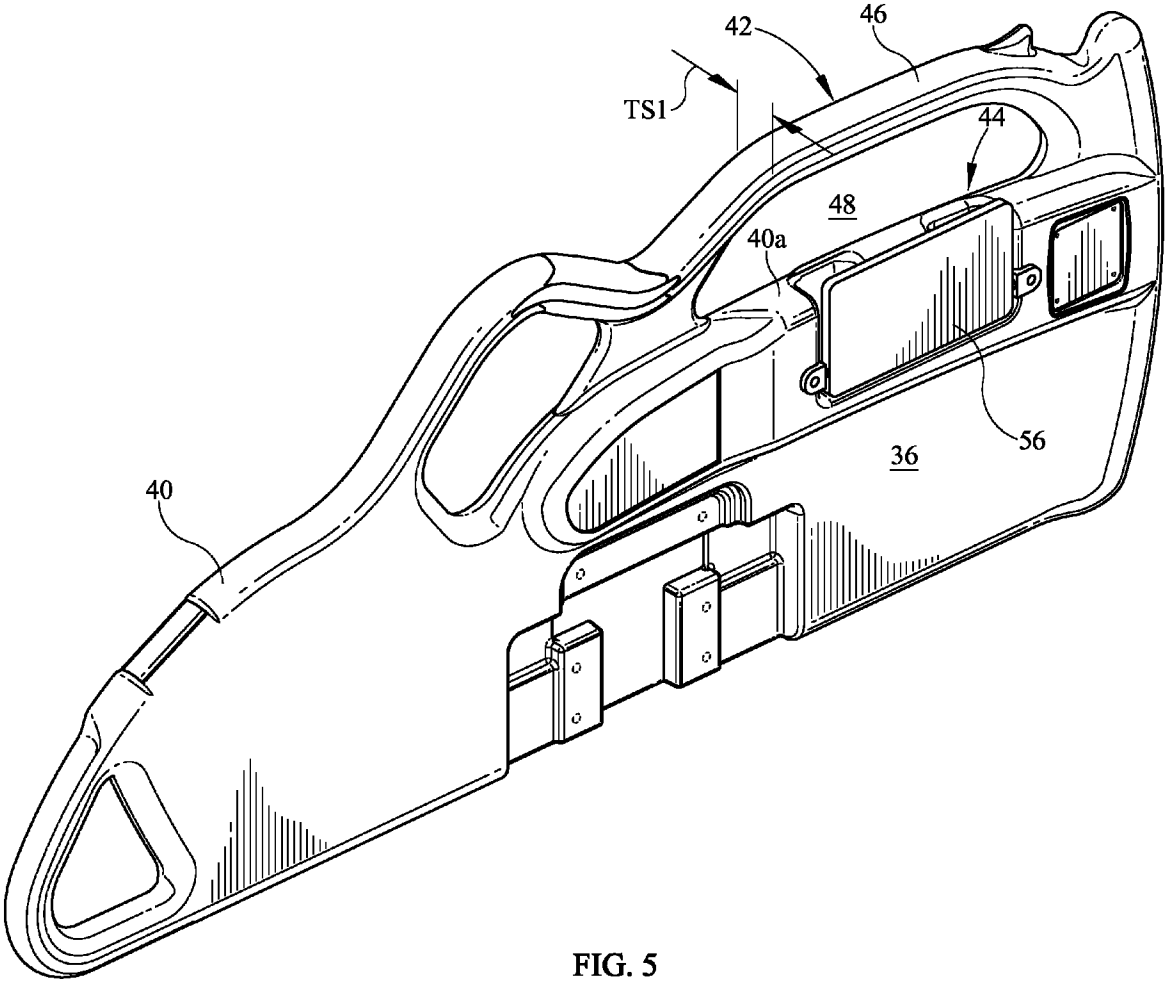
FIG. 5 is a perspective side view of a foot siderail of FIG. 1, including a storage area according to an embodiment of the current disclosure.

In one illustrative embodiment, the storage area back 52 can be recessed into the siderail body 32 between about 0.75 inches and about 1 inch from the first surface 36 of the siderail 24 and can have a width of between about 6.5 inches and about 7 inches and a height of between about 3.5 inches and 4 inches extending from the storage area base 50 to the upper side surface 40*a* as shown in FIGS. 1-3 & 5-7. In another illustrative embodiment the storage area 44 can be recessed into the siderail body 32 between about 0.75 inches and about 1 inch from the second surface 38 of the siderail 24 and can have a width of between about 6.5 inches and about 7 inches and a height of between about 3.5 inches and 4 inches extending from the storage area base 50 to the upper side surface 40*a* as shown in FIG. 4. In yet another illustrative embodiment, the storage area 44 can be recessed into the siderail body 32 between the first surface 36 and the second surface 38 such that the storage area sides 54 can be located between the first surface 36 and the second surface 38 and the storage area base 50 can be recessed from the upper side surface 40*a* between about 3.5 inches and about 4 inches as shown in FIG. 8. In still another embodiment, the storage area 44 can extend from the surface of the endboard EB1 about 12 inches and/or can be recessed into the endboard EB1 between about 0.75 inches and about 1 inch as shown in FIG. 10. It should be appreciated that the height, width, and depth of the storage area 44 can be greater than or less than the previously stated amounts. It should also be appreciated that the storage area 44 can be located on the head siderail 24*a*, the foot siderail 24*b*, and/or the endboards EB1 as shown in FIGS. 1-10. It should further be appreciated that more than the siderail body 32 can include more than one storage area 44 thereon.

Figure 6:
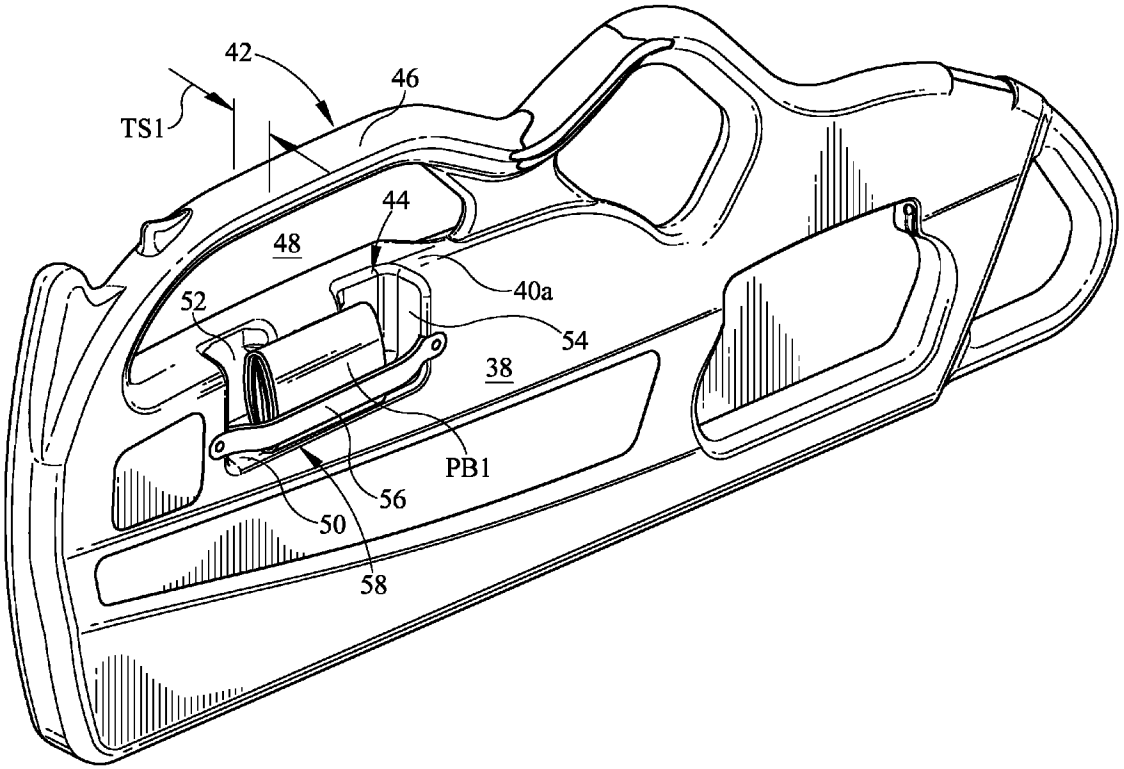
FIG. 6 is a perspective side view of the siderail of FIG. 1, including a storage area according to an embodiment of the current disclosure.
Figure 7:
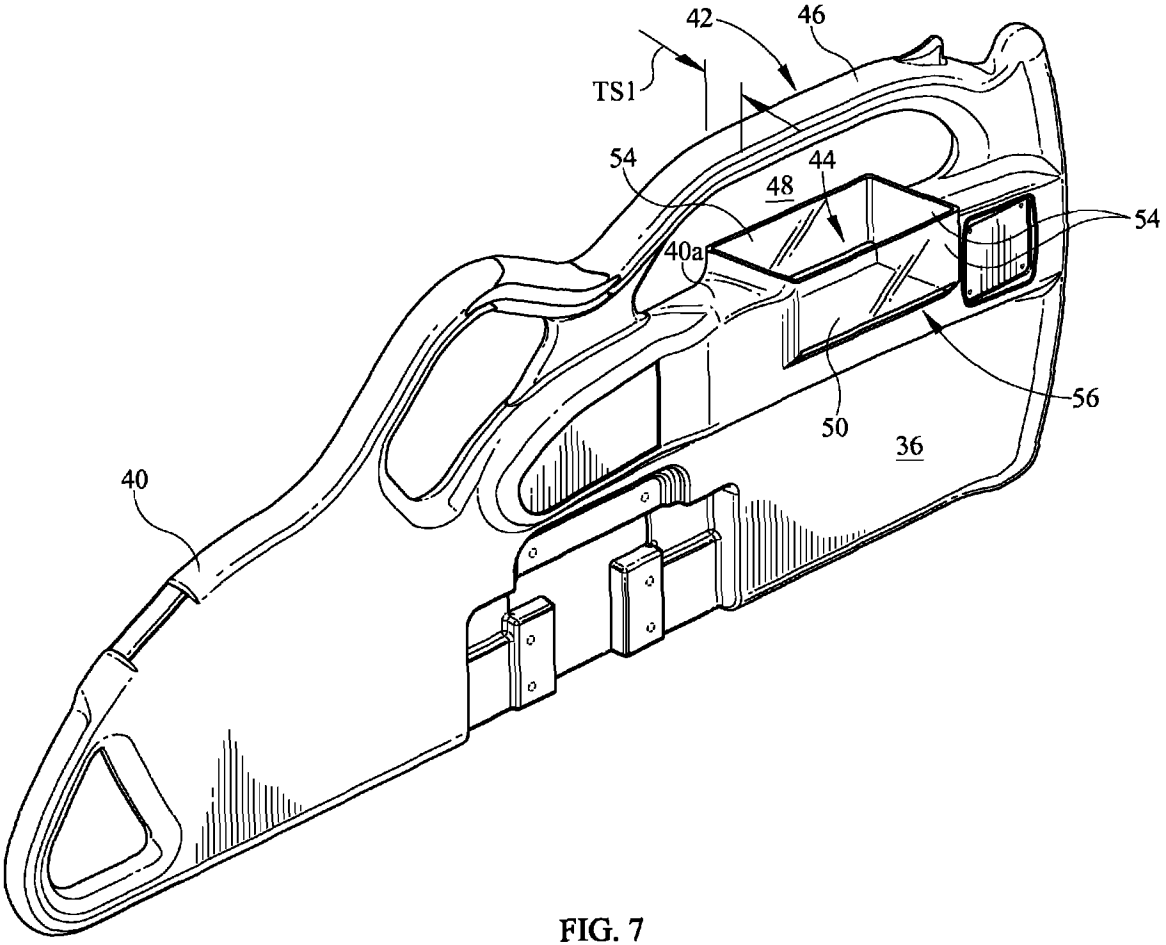
FIG. 7 is a perspective side view of the siderail of FIG. 1, including a storage area according to another embodiment of the current disclosure.
Figure 8:
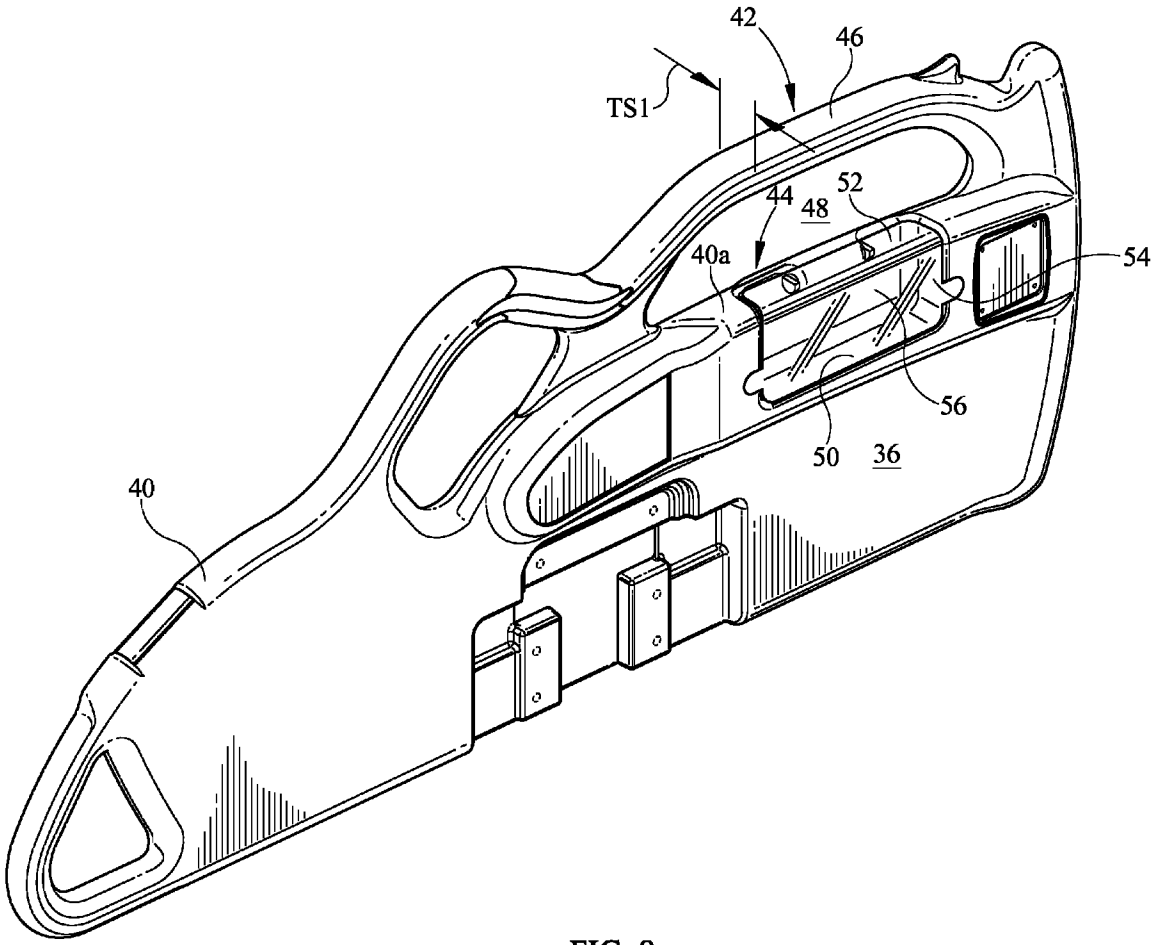
FIG. 8 is a perspective side view of the siderail of FIG. 1, including a storage area according to yet another embodiment of the current disclosure.
Figure 9:
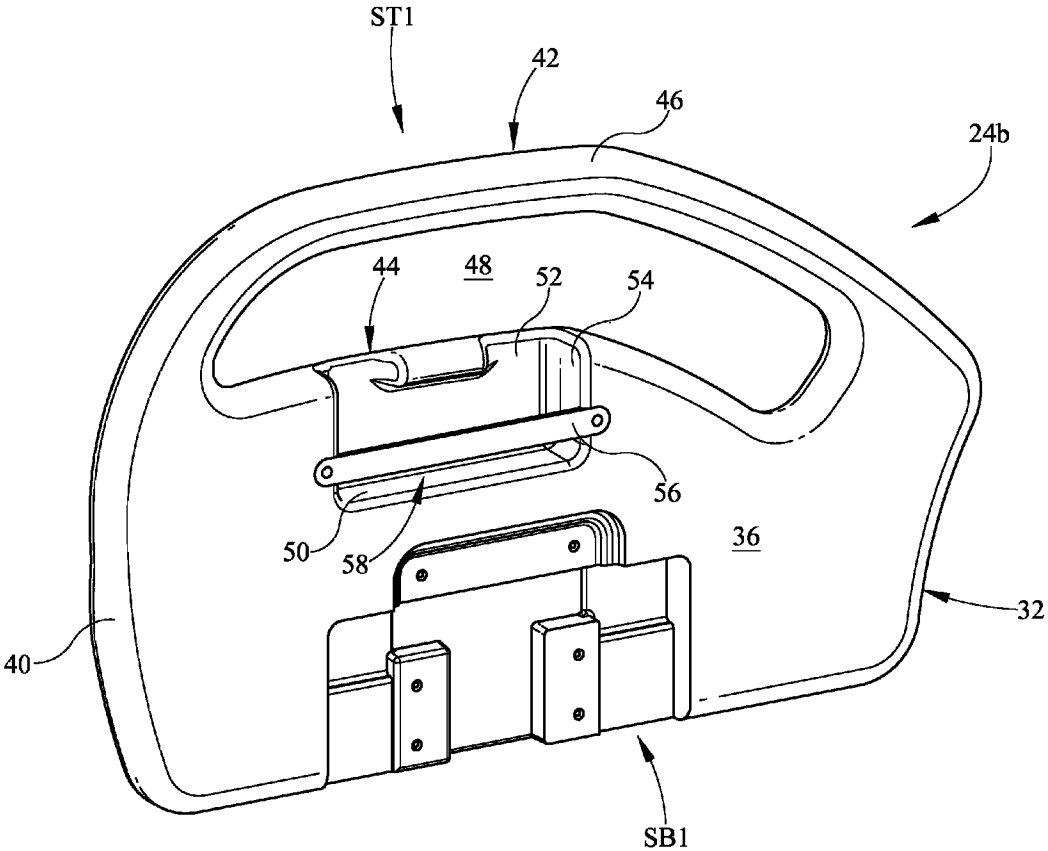

The retaining element 56 can be configured to retain personal belongings PB1 or other objects within the storage area 44 as shown in FIGS. 1-10. In one illustrative embodiment, the retaining element 56 can be or can include at least one of a strap or band, such as, a hook and loop fastener or an elastic band, as shown in FIGS. 2-5. In another illustrative embodiment, the retaining element 56 can be a plate as shown in FIG. 6. In yet another illustrative embodiment, the retaining element 56 can be a cover as shown in FIG. 7. It should be appreciated that at least a portion of the cover can be transparent. In still another illustrative embodiment, the retaining element 56 can be a protrusion or flange (not shown) that can be integrated into the storage area base 50 and/or the storage area sides 54. In other illustrative embodiments, the retaining element 56 can be a rod (not shown), a net, or other retaining mechanisms.

The retaining element 56 can be configured to extend across the width of the storage area 44 and couple with the first surface 36 of the siderail body 32 when the storage area 44 is located on the first surface 36, and couple with the second surface 38 of the siderail body 32 when the storage area 44 is located on the second surface 38 as shown in FIGS. 1-9. It should be appreciated that the retaining element can be integrated into the siderail body. In one illustrative embodiment, the retaining element 56 can extend across the storage area 44 such that there is a clearance space 58 between the storage area base 50 and the retaining element 56. The clearance space 58 can be configured to provide access to the storage area 44 for cleaning purposes.

Many other embodiments of the present disclosure are also envisioned. For example, a person-support apparatus comprises a frame and a siderail. The frame is configured to support a person thereon. The siderail is coupled to the frame. The siderail includes a siderail body with a first surface and a second surface. The first surface is oriented such that the first surface faces toward the frame and the second surface is oriented such that the second surface faces away from the frame. At least one of the first surface and the second surface has a storage area integrated therein. The storage area includes a bottom surface, at least one side surface, and an opening.

In another example a siderail assembly comprises a siderail with a siderail body. The siderail body has a storage area integrated therein. The storage area has a bottom surface, at least one side surface, and an opening. The storage area is configured to removably retain at least one object therein.

In yet another example a siderail assembly for a person-support apparatus comprises a siderail. The siderail includes a siderail body having a first surface, a second surface generally parallel to the first surface, and a third surface extending between about the first surface and about the second surface. The first surface and the second surface are spaced apart a first distance. The siderail body includes a storage area having a bottom surface, at least one side surface, and an opening. The storage area is integrated into the siderail body such that the storage area is at least one of recessed from and extending from at least one of the first surface, the second surface, and the third surface a second distance.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A siderail assembly, comprising:

a siderail including a siderail body, the siderail body including a storage area integrated therein, the storage area including a bottom surface, at least one side surface, a back surface extending between the bottom surface and the at least one side surface and cooperating with the bottom surface and the at least one side surface to define a storage space, an opening into the storage space, and a retaining element extending across the opening and being configured to removably retain at least one object between about the retaining element and the back surface of the storage space, wherein the at least one object is not coupled to the siderail.

2. The siderail assembly of claim 1, wherein the siderail body includes a first surface, a second surface substantially parallel the first surface, and a third surface extending between about the first surface and the second surface, the first surface and the second surface being spaced apart a first distance, the back surface of the storage area being recessed from at least one of the first surface, the second surface, and the third surface a second distance.

3. The siderail assembly of claim 1, wherein the siderail includes a grip portion with a grip and a grip opening positioned between the grip and the siderail body, the grip being configured to be gripped by a person.

4. The siderail assembly of claim 3, wherein the storage area is recessed into the siderail body such that the opening opens into the grip opening.

5. The siderail assembly of claim 1, wherein the storage area is configured to receive and removably retain at least one of personal effects and hand-held objects.

6. The siderail assembly of claim 1, wherein the retaining element is spaced apart from the bottom surface a distance.

7. The siderail assembly of claim 1, wherein the storage area includes a second opening between a portion of the at least one side surface and the bottom surface.

8. A siderail assembly for a person-support apparatus, comprising:

a siderail including a siderail body having a first surface, a second surface being generally parallel to the first surface, and a third surface extending between about the first surface and about the second surface, the first surface and the second surface being spaced apart a first distance, the siderail body including a storage area having a bottom surface, at least one side surface, and an opening, the storage area being integrated into the siderail body such that at least one of the bottom surface and the at least one side surface is at least one of recessed from and extending from at least one of the first surface, the second surface, and the third surface a second distance; and a retaining element extending across the opening and configured to removably retain at least one object within the storage area, wherein the object is not coupled to the siderail.

9. The siderail assembly of claim 8, wherein the first distance is between about 1.5 inches and about 3 inches.

10. The siderail assembly of claim 8, wherein the storage area is recessed from at least one of the first surface, the second surface and the third surface a distance less than about the first distance.

11. The siderail assembly of claim 10, wherein the storage area is recessed from at least one of the first surface, the second surface and the third surface a distance of between about 0.75 inches and about 1 inch.

12. The siderail assembly of claim 8, wherein the retaining element is adjacent to the bottom surface of the storage area.

13. The siderail assembly of claim 12, wherein the retaining element is spaced apart from the bottom surface to define a second opening.

14. A siderail assembly, comprising:

a siderail including a siderail body, the siderail body including a storage area integrated therein, the storage area including a bottom surface, at least one side surface, a back surface extending between the bottom surface and the at least one side surface and cooperating with the bottom surface and the at least one side surface to define a storage space, an opening into the storage space, and a retaining element extending across the opening and being configured to removably retain at least one object within the storage space, wherein the at least one object is not coupled to the siderail assembly.

15. The siderail assembly of claim 14, wherein the storage area is configured to receive and removably retain at least one of personal effects and hand-held objects.

16. The siderail assembly of claim 14, wherein the retaining element is spaced apart from the bottom surface a distance.

* * * * *